US008043116B2

(12) United States Patent
Liao

(10) Patent No.: US 8,043,116 B2
(45) Date of Patent: Oct. 25, 2011

(54) REPLACEABLE MODULE FOR SOCKET AND SOCKET HAVING REPLACEABLE MODULE

(76) Inventor: Sheng-Hsin Liao, Taipei (TW)

( * ) Notice: Subject to any disclaimer, the term of this patent is extended or adjusted under 35 U.S.C. 154(b) by 0 days.

(21) Appl. No.: 12/716,402

(22) Filed: Mar. 3, 2010

(65) Prior Publication Data

US 2011/0151712 A1 Jun. 23, 2011

(30) Foreign Application Priority Data

Dec. 23, 2009 (TW) ..... 98224125 U

(51) Int. Cl.
*H01R 13/60* (2006.01)

(52) U.S. Cl. ..... 439/535

(58) Field of Classification Search ..... 439/535, 439/536, 571

See application file for complete search history.

(56) References Cited

U.S. PATENT DOCUMENTS 5,013,260 A * 5/1991 Caveney et al. ..... 439/535
5,173,061 A * 12/1992 Comerci et al. ..... 439/536
5,354,953 A * 10/1994 Nattel et al. ..... 174/54
5,366,388 A * 11/1994 Freeman et al. ..... 439/540.1
5,366,827 A * 11/1994 Belanger et al. ..... 429/99
6,423,897 B1 * 7/2002 Roesch et al. ..... 174/50
6,722,917 B2 * 4/2004 Huang ..... 439/501
6,768,055 B1 * 7/2004 Gorin ..... 174/50
6,863,561 B2 * 3/2005 Gorman ..... 439/535
6,932,624 B1 * 8/2005 Hoopes et al. ..... 439/76.1
6,956,169 B1 * 10/2005 Shotey et al. ..... 174/58
7,654,855 B2 * 2/2010 Liao ..... 439/441
7,887,341 B2 * 2/2011 Liao ..... 439/131
2002/0185296 A1 * 12/2002 Schultz et al. ..... 174/53
2004/0121648 A1 * 6/2004 Voros ..... 439/535
2004/0219828 A1 * 11/2004 Pulyk ..... 439/535
2006/0065510 A1 * 3/2006 Kiko et al. ..... 200/1 R
2008/0146078 A1 * 6/2008 Braathen ..... 439/536
2008/0293303 A1 * 11/2008 Liao ..... 439/638
2009/0047827 A1 * 2/2009 Liao ..... 439/501

* cited by examiner

*Primary Examiner* — Renee S Luebke
*Assistant Examiner* — Larisa Tsukerman
(74) *Attorney, Agent, or Firm* — C. G. Mersereau; Nikolai & Mersereau, P.A.

(57) ABSTRACT

A socket having a replaceable module includes a socket panel and a replaceable module. The socket panel is provided with socket units. The replaceable module is detachably provided on the socket panel. The replaceable module is provided with socket subunits. The edge of the replaceable module is provided with a trough located between the replaceable module and the socket panel. The present invention further provides a replaceable module for a socket. The replaceable module can be replaced according practical demands, which makes it more versatile. Further, the replaceable module has a better safety.

14 Claims, 18 Drawing Sheets

REPLACEABLE MODULE FOR SOCKET AND SOCKET HAVING REPLACEABLE MODULE

BACKGROUND OF THE INVENTION

1. Field of the Invention

The present invention relates to a modular structure, and in particular to a replaceable module for a socket and a socket having a replaceable module.

2. Description of Related Art

Nowadays, electric cables or signal lines are usually buried in walls of a building. Further, sockets are provided on the walls to be electrically connected to the electric cables or the signal lines. When an electronic product (such as a mobile phone, digital camera, PDA or other portable electronic device) needs to be charged for maintaining its normal operation or such an electronic product has to be connected to the Internet for transmitting data, a user has to connect the electronic product to the socket by means of a connecting line and a plug. In this way, the electronic product can be connected to the electric cables or signal lines buried in the walls, thereby obtaining the electricity or network signals.

The conventional socket has a socket panel that is integrally formed with the socket. The socket panel is provided with socket units and switches that are fixed and unchangeable. Therefore, such a socket panel cannot be changed according to practical demands, which causes limitations in use. Thus, it is necessary to manufacture various kinds of socket units and switches for different applications, which increases the manufacturing cost.

In order to overcome the problems of the above-mentioned socket, the present inventor proposes a novel and reasonable structure based on his delicate researches and expert experiences.

SUMMARY OF THE INVENTION

An objective of the present invention is to provide a replaceable module for a socket and a socket having a replaceable module. The replaceable module can be detached and replaced according to practical demands, which makes the socket become versatile. Further, the manufacturing cost can be reduced.

Another objective of the present invention is to provide a replaceable module for a socket and a socket having a replaceable module. The replaceable module has a better safety.

To achieve the above objectives, the present invention provides a socket having a replaceable module, which includes: a socket panel provided with socket units; and a replaceable module detachably provided on the socket panel, the replaceable module being provided with socket subunits, an edge of the replaceable module being provided with a trough located between the replaceable module and the socket panel.

The present invention further provides a replaceable module for a socket. The replaceable module is provided with socket subunits. The edge of the replaceable module is provided with a trough.

The present invention has advantageous features as follows. Since the replaceable module can be detachably provided on the socket panel, and the replaceable module is provided with different socket subunits, so that the replaceable module can be replaced according to practical demands, the replaceable module can be changed according to practical demands, which makes the socket more versatile. Thus, it is unnecessary to manufacture various socket panels, so that the manufacturing cost can be reduced.

Since the replaceable module is provided in the socket panel, and the replaceable module cannot be drawn out of the socket panel easily, the replaceable module can be prevented from being drawn out of the socket panel accidentally, which increases the safety of the socket. The edge of the replaceable module has a trough hidden between the replaceable module and the socket panel. Thus, a user has to insert a tool into the trough so as to force the replaceable module to move forwards, thereby drawing the replaceable module out of the socket panel for repair or replacement.

In order to further understand the characteristics and technical contents of the present invention, a description relating thereto will be made with reference to the accompanying drawings. However, the drawings are illustrative only but not used to limit the present invention.

DETAILED DESCRIPTION OF THE PREFERRED EMBODIMENTS

Figure 7:
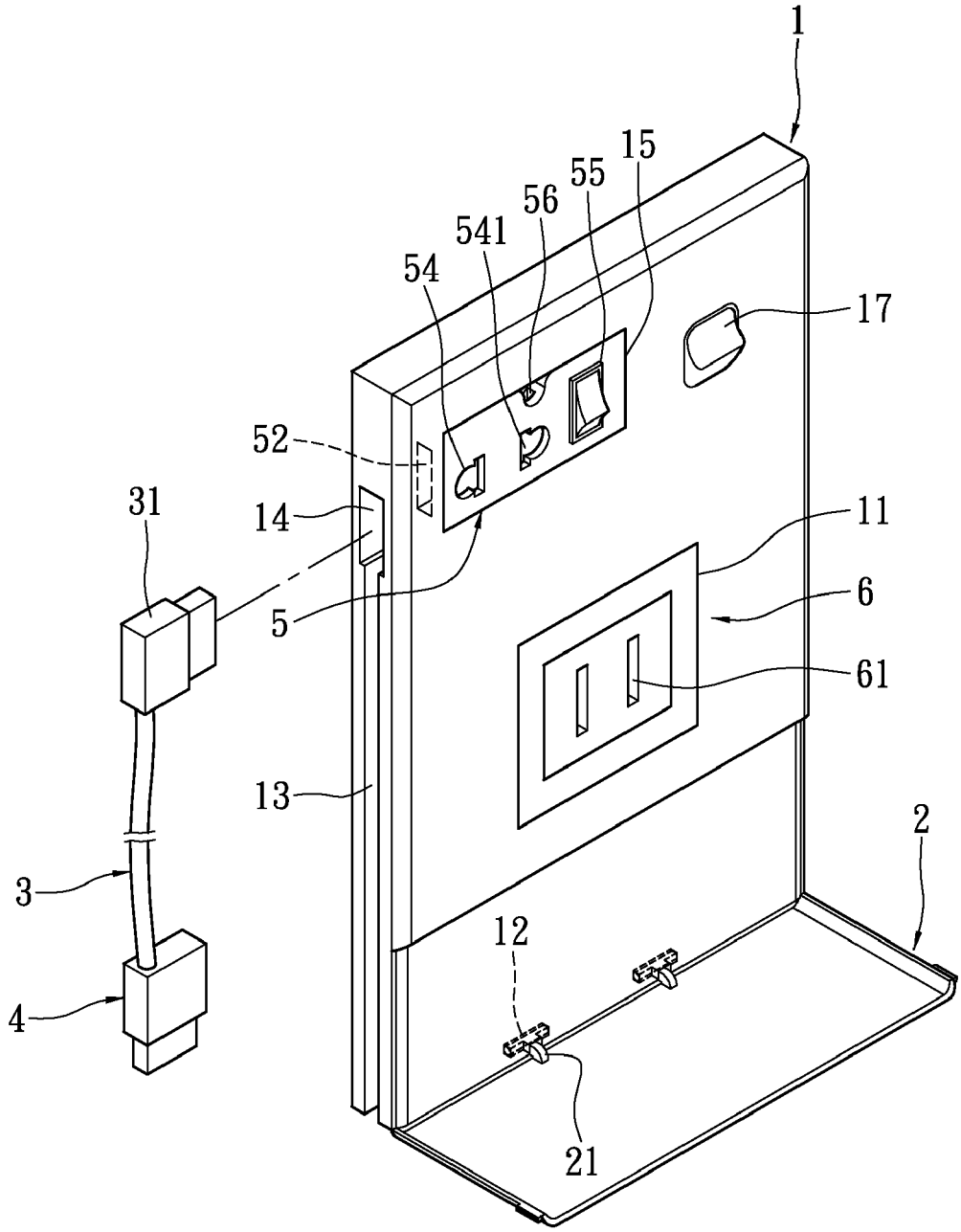
FIG. 7 is a perspective view showing the socket having a replaceable module according to a second embodiment of the present invention.

Please refer to FIGS. 1 to 5, which show the socket having a replaceable module according to the first embodiment of the present invention. The socket includes a socket panel 1, a supporting plate 2, a connecting line 3, an electrical connector 4, and a replaceable module 5. The socket panel 1 is formed into a square plate. However, the shape and dimension of the socket panel 1 are not limited thereto, and can be changed according to practical demands. The socket panel 1 is constituted of single layer or a plurality of layers of plates. The socket panel 1 is provided with at least one socket unit 6 and a main switch 17. The socket unit 6 has at least one set of insertion holes 61. The form and dimension of the socket unit 6 are not limited thereto, and can be any suitable insertion holes or electrical connector. The socket panel 1 may be also provided with at least one engaging portion 11 (FIG. 7). The engaging portion 11 is a through hole of a square shape or other shapes corresponding to the shape of the socket unit 6, so that the engaging portion 11 can be engaged with the outer edge of the socket unit 6. The socket panel 1 can be fixed on a wall or other suitable locations by means of screw elements or engaging elements (not shown).

In the present embodiment, an accommodating box 20 is provided. The front side of the accommodating box 20 has an opening 201. The accommodating box 20 is disposed on the rear side of the socket panel 1. The support plate 2 is positioned in the opening 201 of the accommodating box 20 to move forwards or rearwards along the opening 201.

The edge of the socket panel 1 is provided with a cable slot 13 for receiving the connecting line 3, whereby the connecting line 3 can surround the edge of the socket panel 1. The location of the cable slot 13 is not limited thereto. The cable slot 13 can be provided at any suitable locations on the edge of the socket panel 1, such as the left side, right side, top side or bottom side of the socket panel 1. The edge of the socket panel 1 is further provided with a receiving trough 14 and an accommodating trough 16. The receiving trough 14 and the accommodating trough 16 are connected to both ends of the cable slot 13 respectively. The receiving trough 14 and the accommodating trough 16 are in communication with the cable slot 13 for receiving a connecting portion 31 and the electrical connector 4 respectively.

The connecting line 3 is constituted of conductors and an insulating layer coated outside the conductors. However, the structure and form of the connecting line 3 are not limited thereto, and various suitable cables or flat cables may be used. One end of the connecting line 3 is connected to the connecting portion 31. The connecting portion 31 may be a USB connector, IEEE1394 connector, HDMI connector, AV terminal, DC terminal or other electrical connectors. Of course, one end of the connecting line 3 can be electrically connected to the replaceable module 5 by other suitable means. The connecting line 3 selectively surrounds the edge of the socket panel 1. That is, the connecting line 3 can also surround inside the cable slot 13 at the edge of the socket panel 1, so that the connecting line 3 can be fixed suitably even not in use. Of course, the connecting line 3 can be drawn out of the cable slot 13 for use.

The electrical connector 4 can be a USB connector, IEEE1394 electrical connector, AV terminal, DC terminal or other electrical connectors. The electrical connector 4 may be a male-type connector or a female-type connector. The dimension and form of the electrical connector 4 are not limited thereto. The electrical connector 4 is connected to the other end of the connecting line 3. The interior of the electrical connector 4 is provided with a plurality of terminals (not shown). The terminals are made of electrical-conductive materials. These terminals are electrically connected to the conductors in the connecting line, so that the electrical connector 4 can be electrically connected to the connecting line 3.

The replaceable module 5 is a plate of a square shape or other suitable shape. The area of the replaceable module 5 is smaller than that of the socket panel 1. The replaceable module 5 is provided with at least one socket subunit 54 and a switch 55. The socket subunit 54 has at least one set of insertion holes 541. The dimension and form of the socket submit 54 are not limited thereto, and various insertion holes or electrical connectors may be used. The replaceable module 5 is detachably provided on the socket panel 1. The front side of the socket panel 1 is provided with a receiving trough 15 corresponding to the replaceable module 5, so that the replaceable module 5 can be received in the receiving trough 15. The replaceable module 5 can be fixed to the socket panel 1 by means of a screw 51.

The edge of the replaceable module 5 is provided with a modular connector 52 corresponding to the receiving trough 14. The modular connector 52 is a USB connector, IEEE1394 connector, HDMI connector, AV terminal, DC terminal, or other electrical connectors. The modular connector 52 is provided on one side of the replaceable module 5 adjacent to the receiving trough 14, so that the connecting portion 31 can be inserted into the modular connector 52 when the connecting portion 31 is received in the receiving trough 14. In this way, the connecting line 3 and the electrical connector 4 can be electrically connected with the replaceable module 5 by means of the connecting portion 31 and the modular connector 52. Further, the connecting portion 31 is inserted into the receiving trough 14 and the modular connector 52 to provide a better fixing effect. Thus, the connecting portion 31 can be firmly inserted into the socket panel 1 and the replaceable module 5.

Figure 1:
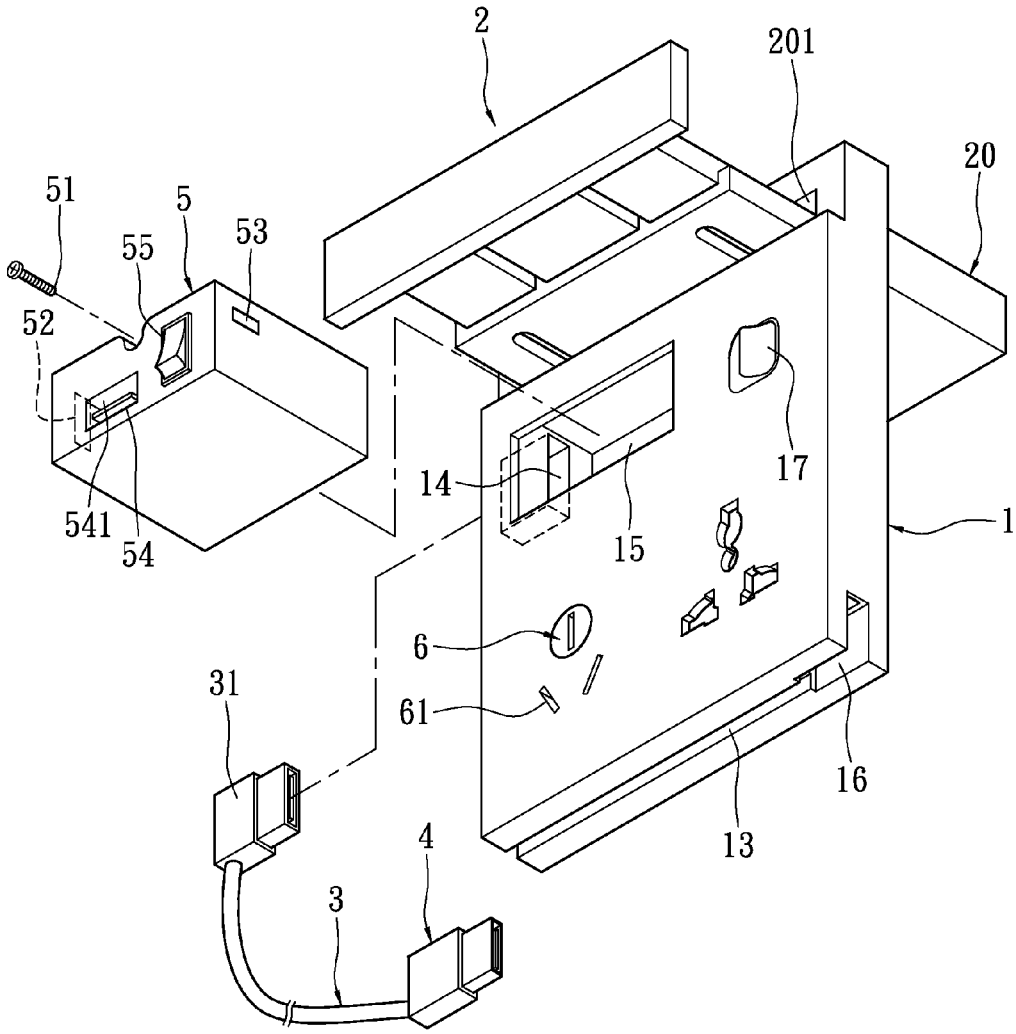
FIG. 1 is an exploded perspective view showing a socket having a replaceable module according to a first embodiment of the present invention.
Figure 2:
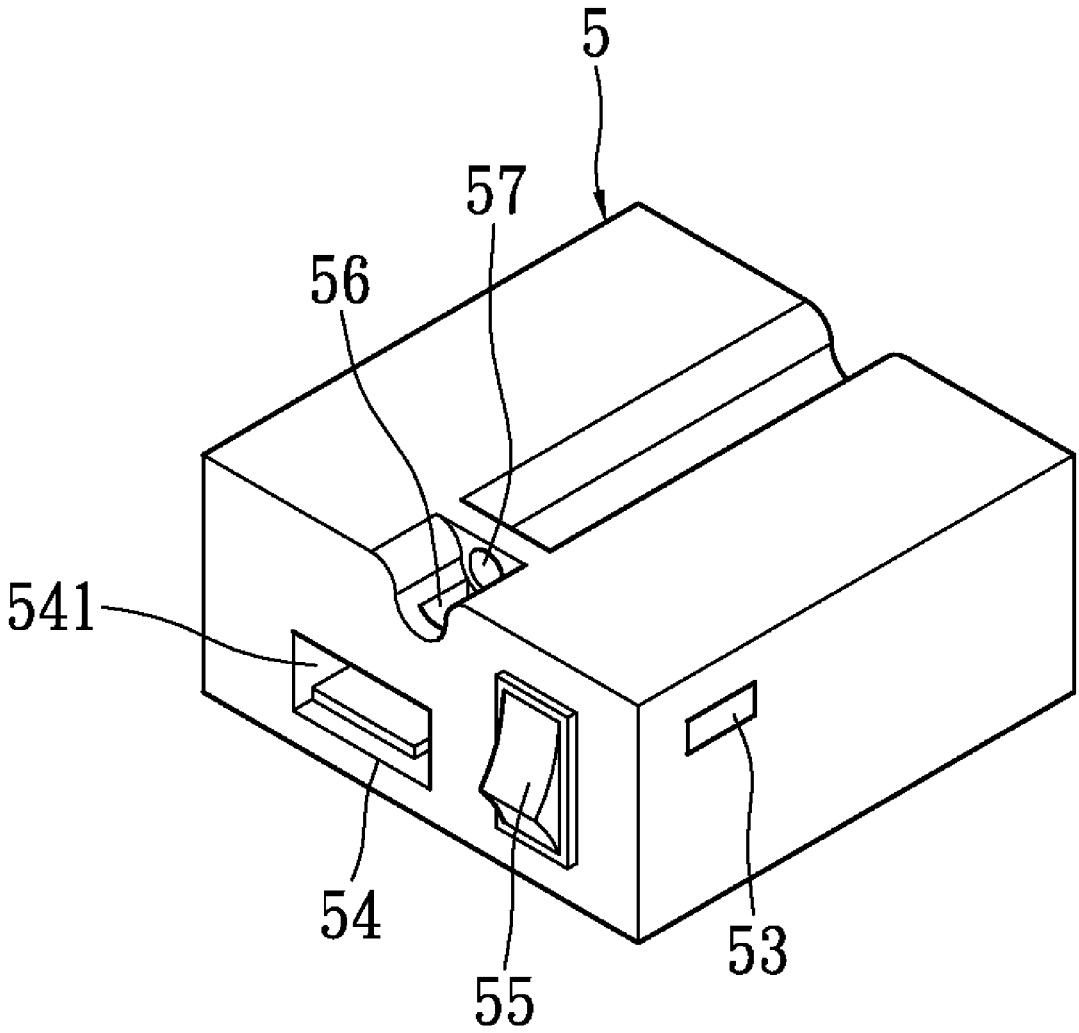
FIG. 2 is a perspective view showing a replaceable module according to the first embodiment of the present invention.
Figure 3:
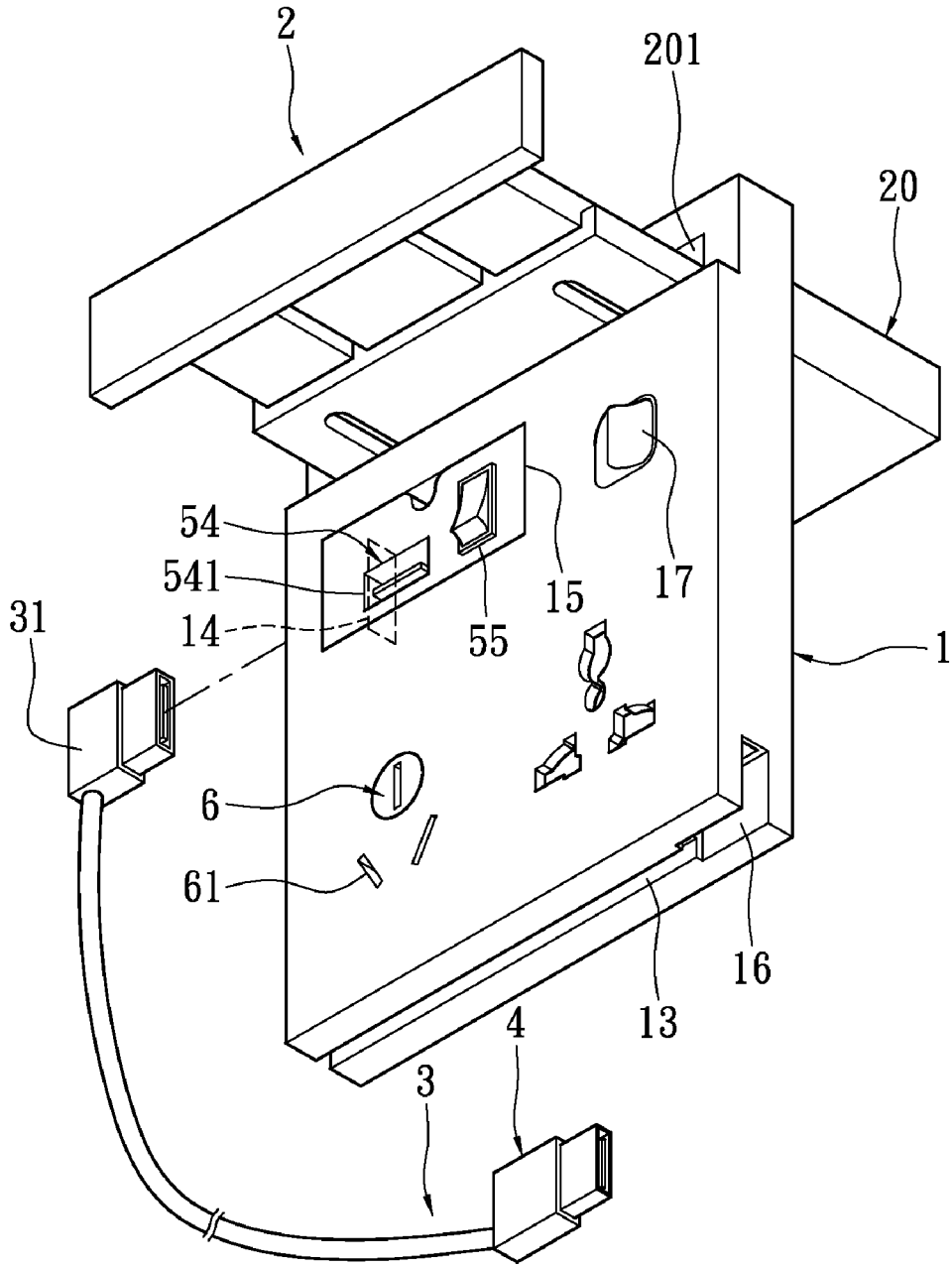
FIG. 3 is a perspective view showing the socket having a replaceable module according to the first embodiment of the present invention.
Figure 4:
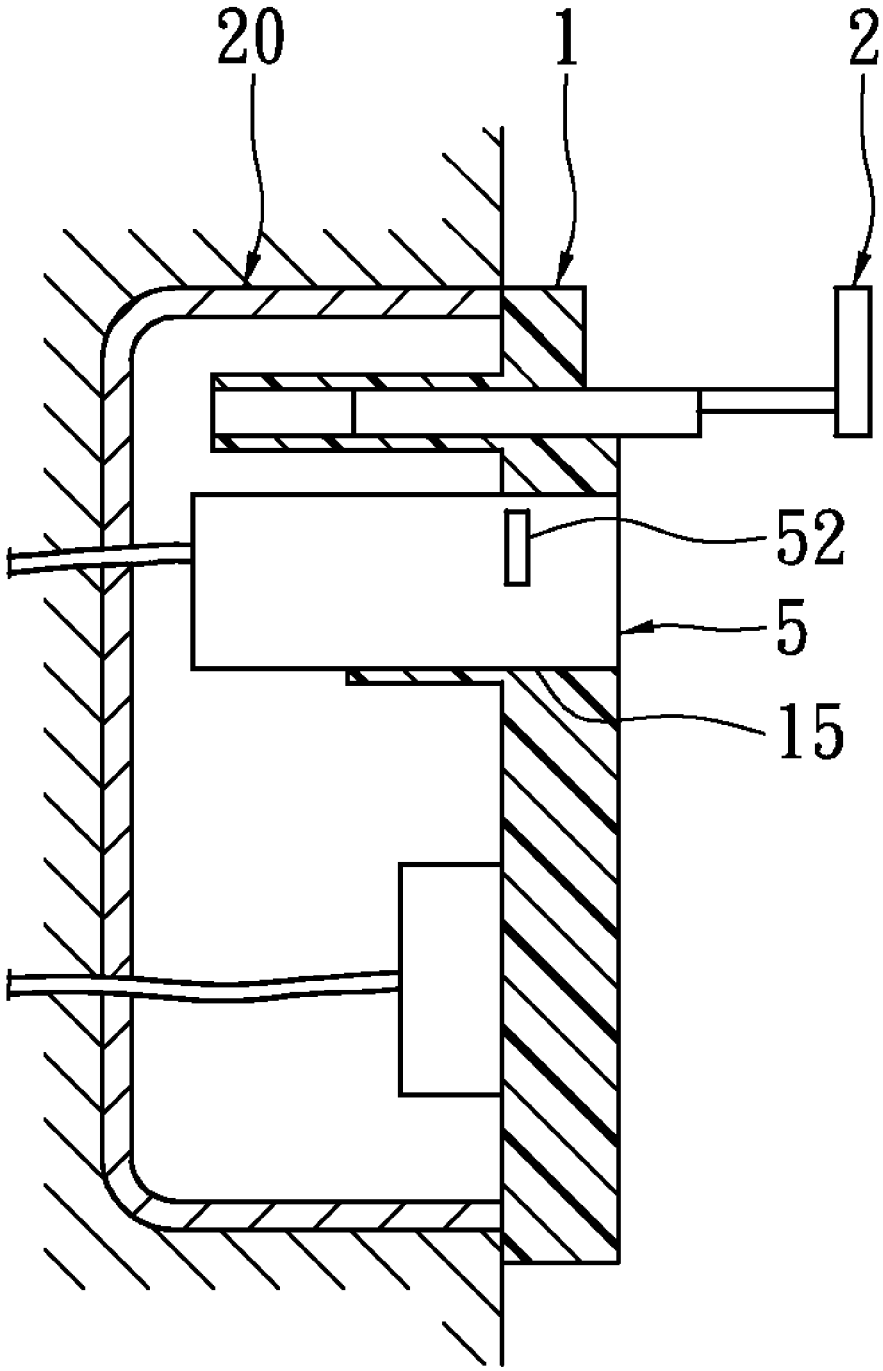
FIG. 4 is a cross-sectional view showing the socket having a replaceable module according to the first embodiment of the present invention.
Figure 5:
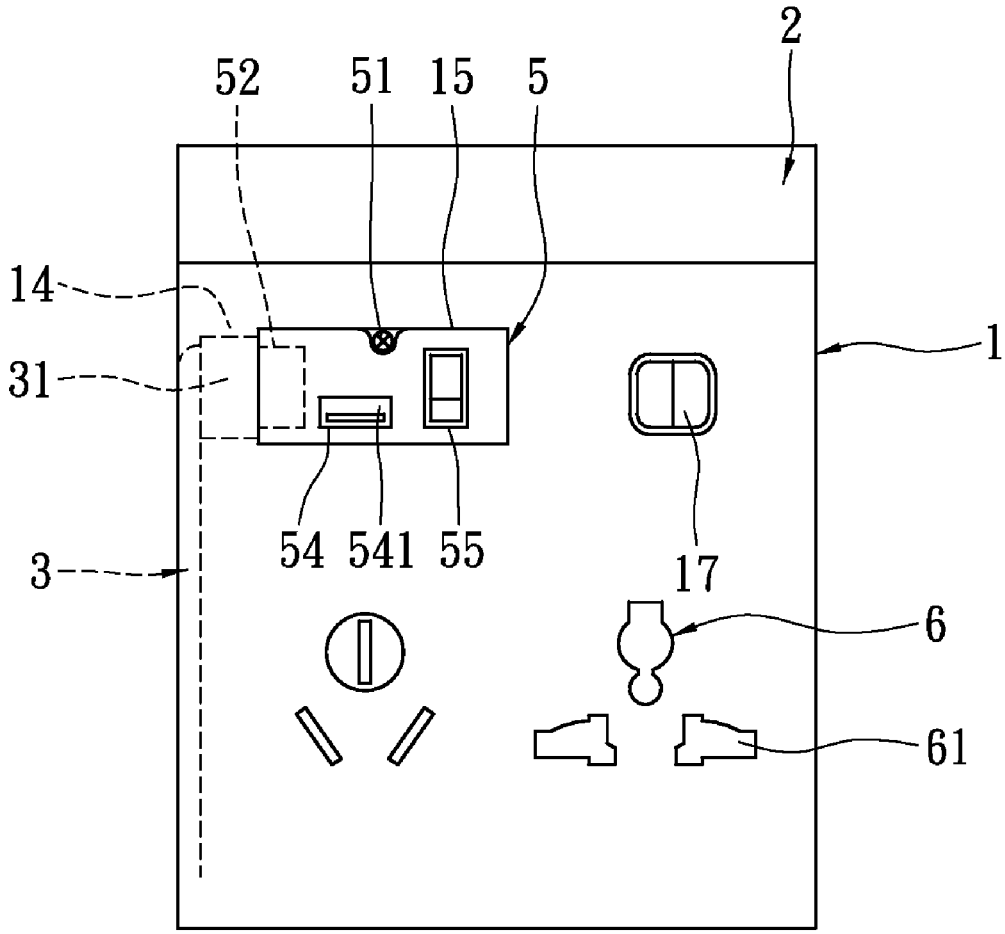
FIG. 5 is a front view showing the socket having a replaceable module according to the first embodiment of the present invention.
Figure 6:
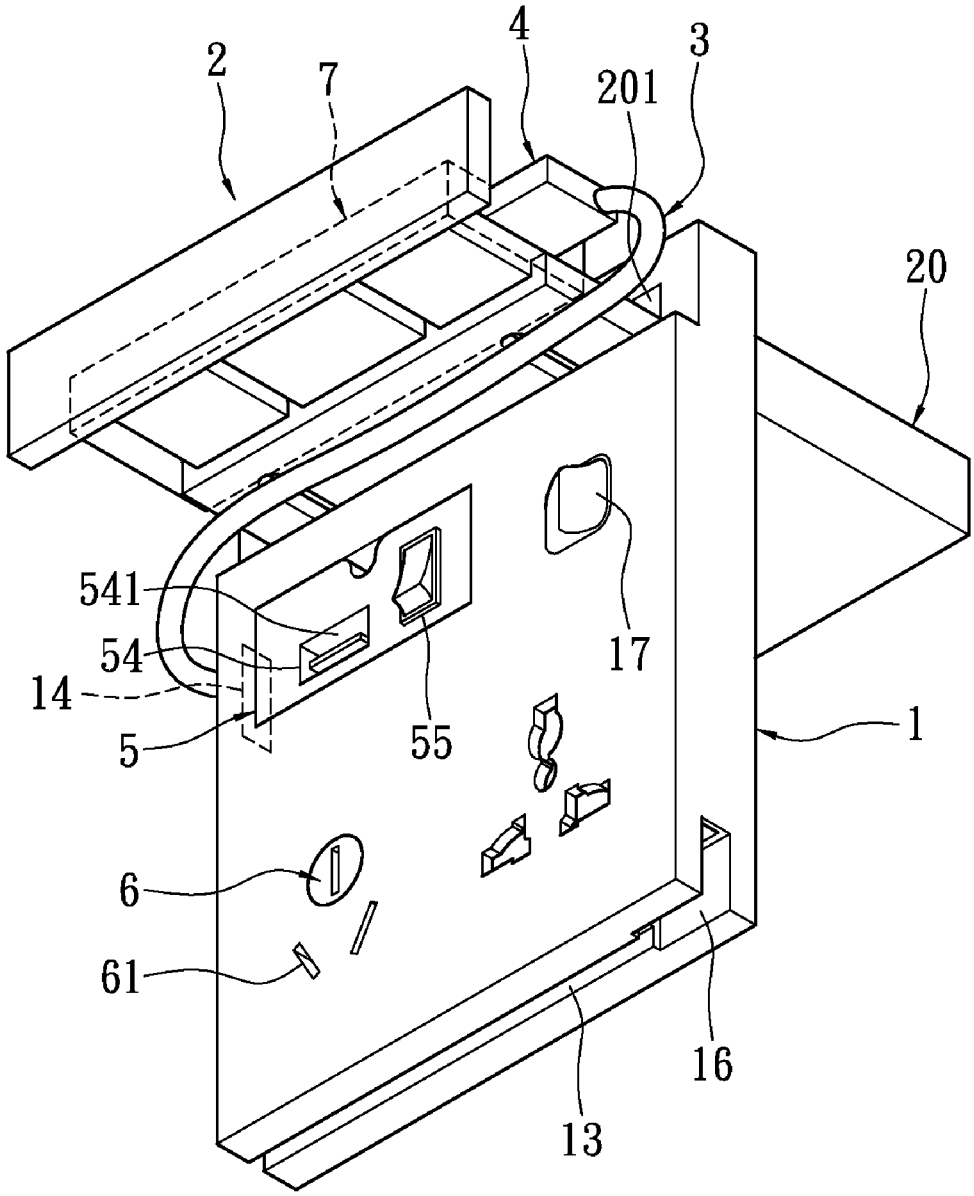
FIG. 6 is a perspective view showing an operating state of the socket having a replaceable module according to the first embodiment of the present invention.

The edge of the replaceable module 5 is provided with a trough 56 (as shown in FIG. 4). The trough 56 is preferably located in the middle of the upper edge of the replaceable module 5. The replaceable module 5 is provided with a locking hole 57. The trough 56 is located in front of the locking hole 57. A screw 51 is inserted into the locking hole 57, so that the replaceable module 5 can be fixed on the socket panel 1 by means of the screw 51. When the replaceable module 5 is received in the receiving trough 15, the trough 56 is located between the replaceable module 5 and the socket panel 1. Thus, the trough 56 can be hidden and not seen by children easily.

The replaceable module 5 may be used as a charger having charging circuit therein (not shown). The outside of the replaceable module 5 is provide with one, two or more electrical contacts 53 as inputting ends for contacting and electrically connecting the corresponding electrical contacts (not shown) on the socket panel 1. In this way, the replaceable module 5 can be electrically connected to the circuit within the socket panel 1, so that the electricity or signals of the socket panel 1 can be transmitted to the replaceable module 5. The modular connector 52 and the socket subunits 54 can be used as output ends. The replaceable module 5 is further provided with a transformer, night lamp, sensor or the like.

As shown in FIGS. 1 to 6, when the user intends to electrically connect an electronic product 7 (such as a mobile phone) to the electrical connector 4, the user draws the supporting plate 2 along the opening 201 out of the accommodating box 20. Then, the user inserts the electrical connector 4 into the electronic product 7, so that the electronic product 7 can be kept stable and firm during the electrical connection, charging operation and Internet connection by means of the connecting line 3 and the electrical connector 4. Alternatively, the supporting plate 2 may be omitted (as shown in FIG. 8), but in this case, the electronic product 7 has to be disposed on other suitable locations.

According to the present invention, the socket panel 1 is combined with the connecting line 3 and the electrical connector 4 in such a manner that the connecting line 3 and the electrical connector 4 are movably provided on the socket panel 1. When the user needs to use the connecting line 3 and the electrical connector 4, the user only needs to draw the connecting line 3 and the electrical connector 4 out of the cable slot 13 and the accommodating trough 16 of the socket panel 1. In this way, the user can find the connecting line 3 and the electrical connector 4 quickly without taking a lot of time. Thus, the present invention is easy to use. When the connecting line 3 and the electrical connector 4 are not in use, the user needs not to remove the connecting line 3 and the electrical connector 4 from the socket panel 1 because the connecting line 3 and the electrical connector 4 can be stored in the cable slot 13 and the accommodating trough 16 of the socket panel 1. Thus, the connecting line 3 and the electrical connector 4 will not get lost and are easy to use. Further, the connecting line 3 and the electrical connector 4 can be arranged in order, so that it is very convenient for the user to use the socket.

Figure 8:
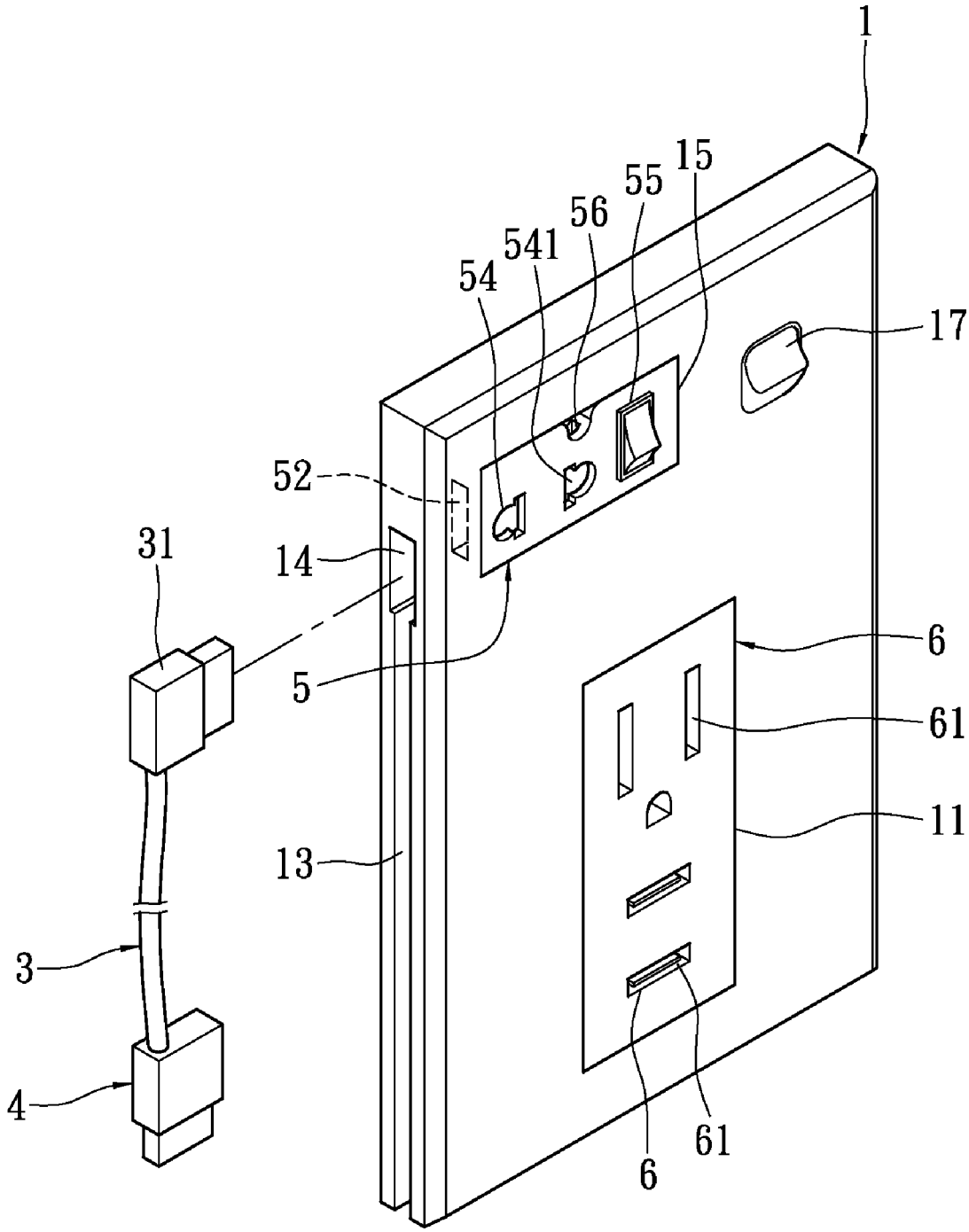
FIG. 8 is a perspective view showing the socket having a replaceable module according to a third embodiment of the present invention.
Figure 9:
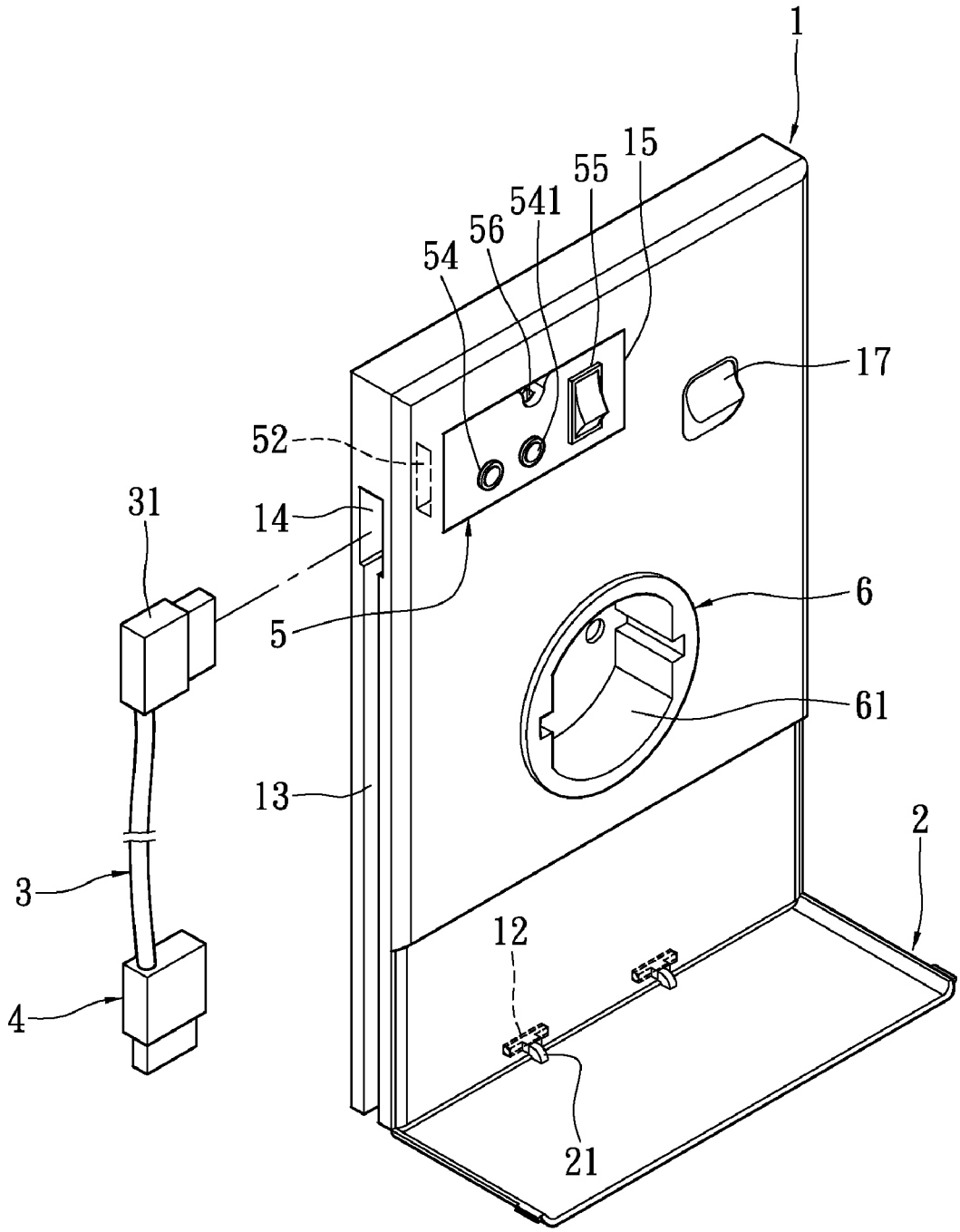
FIG. 9 is a perspective view showing the socket having a replaceable module according to a fourth embodiment of the present invention.

Please refer to FIGS. 7 to 9, which show the second to fourth embodiments of the present invention. The socket unit 6 and the socket subunit 54 can be of other dimensions and forms. The socket unit 6 and the socket subunit 54 can be a USB connector, IEEE1394 connector, HDMI connector, AV terminal, DC terminal or other insertion holes or electrical connectors. As shown in FIG. 7 and FIG. 9, the bottom side of the socket panel 1 is provided with two first pivoting portions 12. Each of the first pivoting portions 12 is a pivotal hole. The supporting plate 2 is located on the front side of the socket panel 1. One side of the supporting plate 2 is provided with two second pivoting portions 21. Each of the second pivoting portions 21 is a pivotal shaft. One side of the supporting plate 2 is pivotally connected with the two first pivoting portions 12 on the bottom side of the socket panel 1 by means of both second pivoting portions 21. Thus, the supporting plate 2 can be turnably connected to the socket panel 1. With this arrangement, the supporting plate 2 can be turned downwardly to a horizontal position for allowing an electronic product to be disposed thereon. Alternatively, the supporting plate 2 can be turned upwardly for covering the front side of the socket panel 1.

Figure 10:
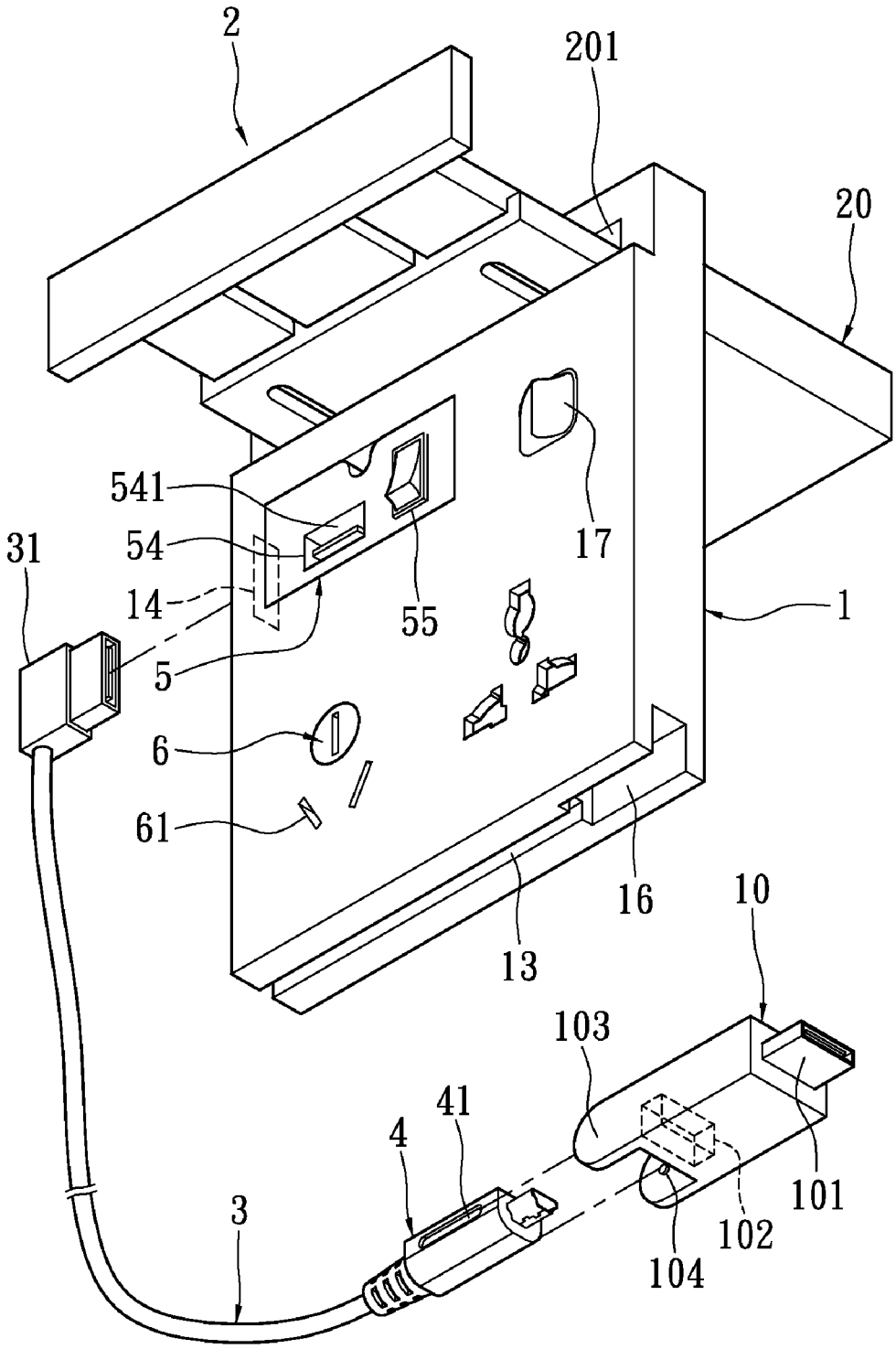
FIG. 10 is a perspective view showing the socket having a replaceable module according to a fifth embodiment of the present invention.

Please refer to FIG. 10, which shows the fifth embodiment of the present invention using another form of the electrical connector 4. The electrical connector 4 is further combined with an adapter 10. The adapter 10 has a first insertion element 101 and a second insertion element 102 disposed at the front and rear ends thereof respectively. The adapter 10 has two side arms 103 extended from two sides of the rear end thereof. Each of the side arms 103 is formed with a pivoting portion 104 on an inner surface thereof respectively. The pivoting portion 104 is a post. Both of the side arms 103 can be rotary or stationary. In the present embodiment, both of the side arms 103 are stationary, so that they are fixedly connected to both sides of the adapter 10. If the side arms 103 are rotary, they can be pivotally connected to both sides of the adapter 10 by means of pivots, so that both of the side arms 103 can rotate freely. The first insertion element 101 and the second insertion element 102 are electrically connected to each other. Terminals (not shown) are provided between the first insertion element 101 and the second insertion element 102, so that the first insertion element 101 can be electrically connected to the second insertion element 102.

The electrical connector 4 has two grooves 41 concaved inwardly from two sides thereof respectively. With this arrangement, the electrical connector 4 is assembled with the adapter 10 in such a manner that the electrical connector 4 can be moved forwards or rearwards. The pivoting portion 104 is received in the groove 41, so that the electrical connector 4 is movably assembled with the adapter 10. The front end of the electrical connector 4 is inserted into the second insertion element 102 to achieve electrical connection. With this arrangement, the adapter 10 can be electrically connected with the connecting line 3 by means of the electrical connector 4.

The adapter 10 is movably assembled with the electrical connector 4 in a pivotal and slidable manner. The electrical connector 4 can rotate and slide with respect to the adapter 10, so that the adapter 10 can be inserted into the front end of the electrical connector 4 to achieve the connection. When the adapter 10 is not in use, the adapter 10 can rotate to different orientations. In this way, the electrical connector 4 can be used individually without disassembling the adapter 10.

Figure 11:
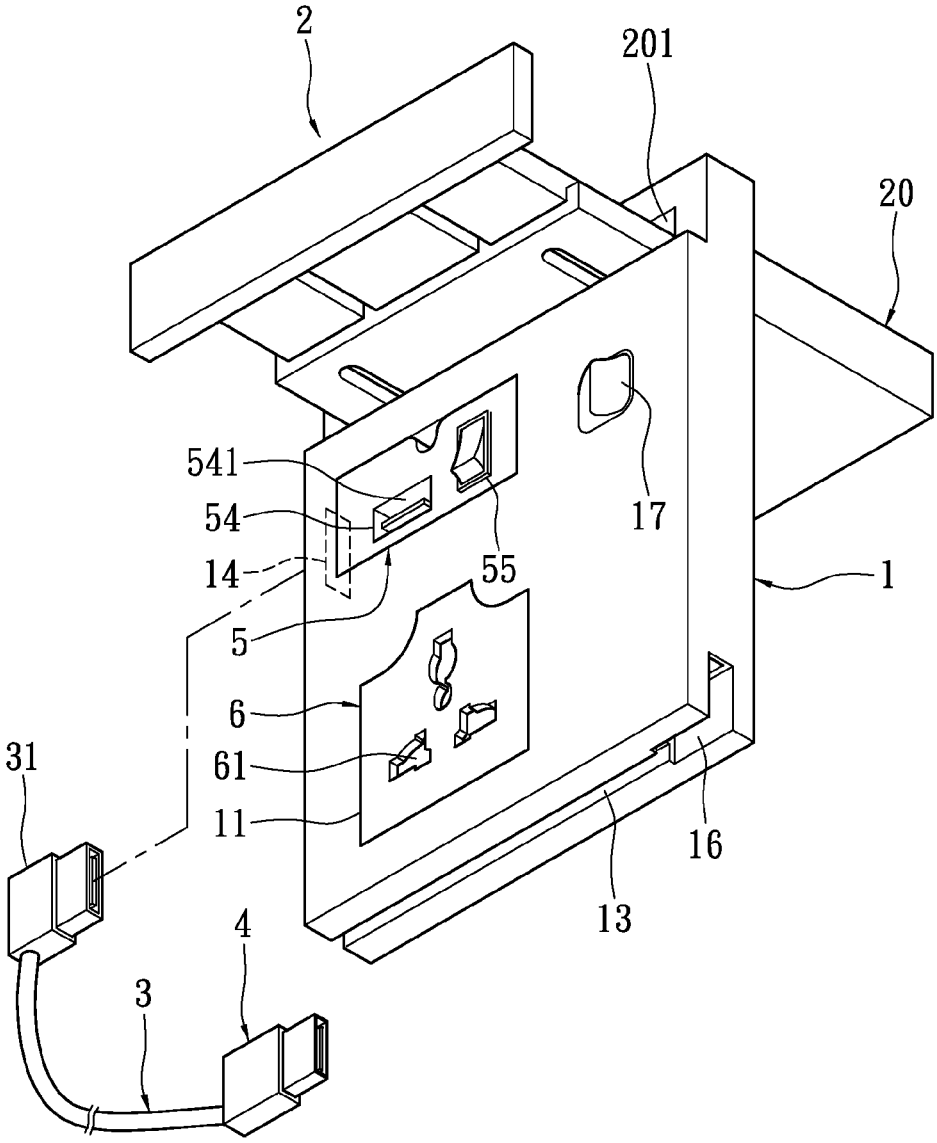
FIG. 11 is a perspective view showing the socket having a replaceable module according to a sixth embodiment of the present invention.

Please refer to FIG. 11, which shows the sixth embodiment of the present invention. The dimension and the form of the socket unit 6 can be chosen according to practical demands. The socket panel 1 is formed with an engaging portion 11 that is engaged with the outer edge of the socket unit 6.

Figure 12:
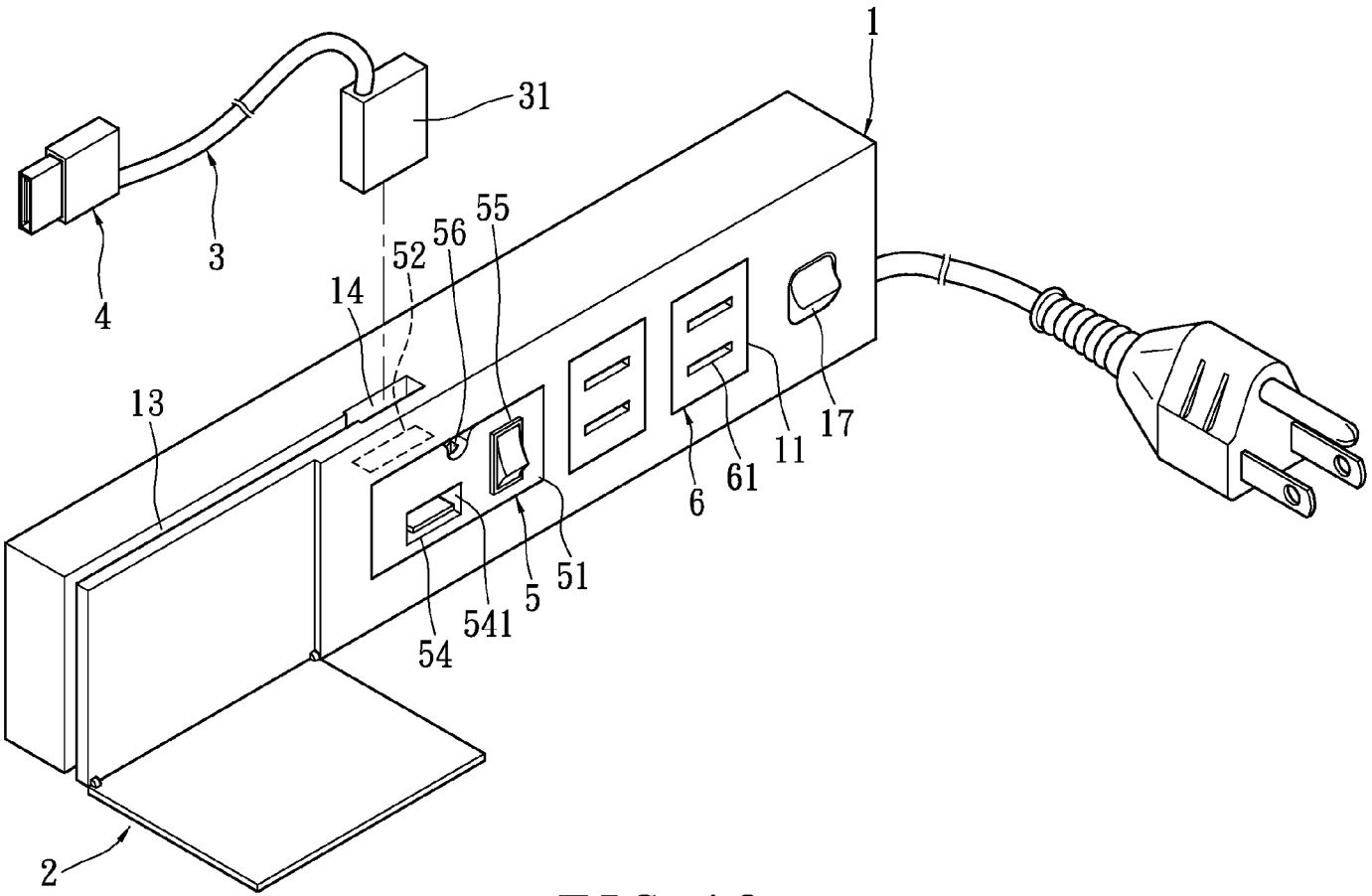
FIG. 12 is a perspective view showing the socket having a replaceable module according to a seventh embodiment of the present invention.

Please refer to FIG. 12, which shows the seventh embodiment of the present invention. The socket is a power outlet having an extension line.

Figure 13:
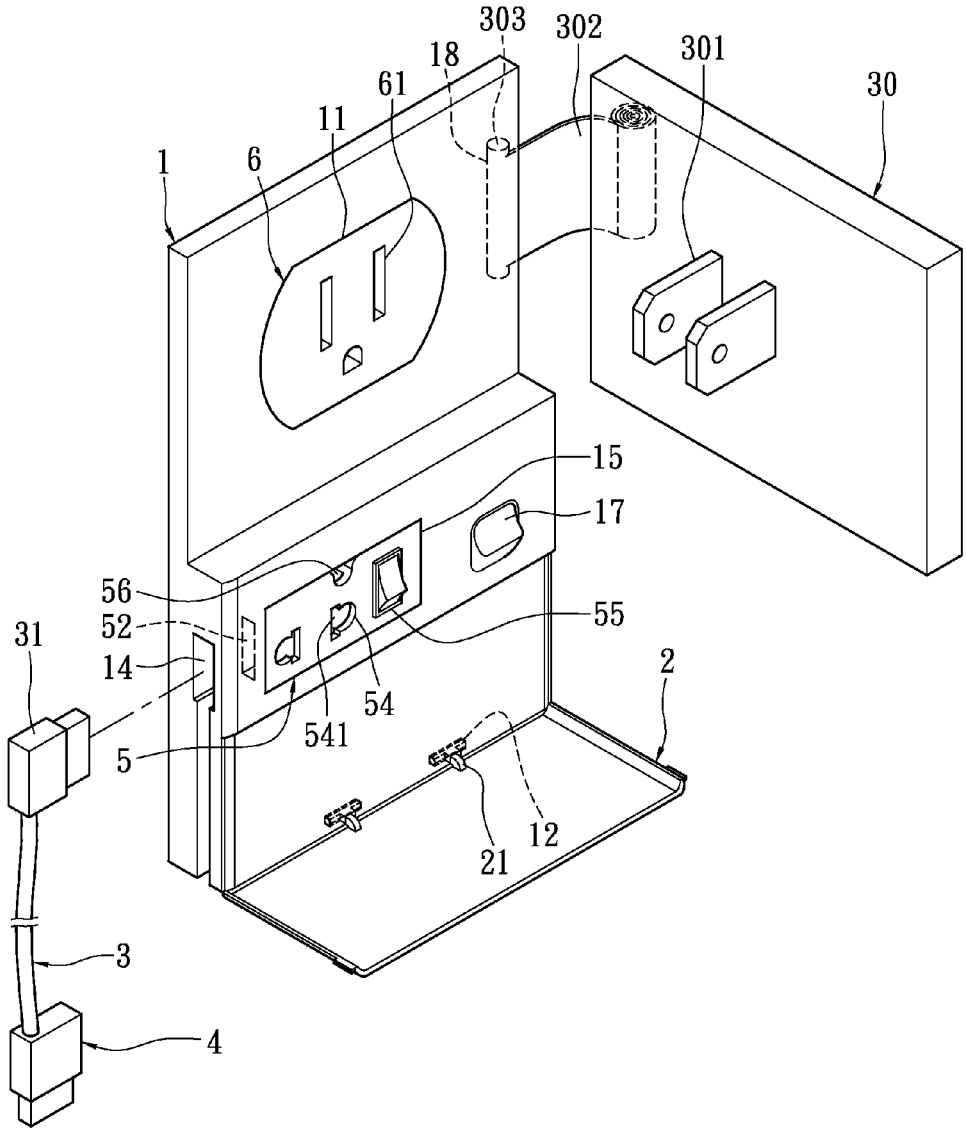
FIG. 13 is a perspective view showing the socket having a replaceable module according to a eighth embodiment of the present invention.

Please refer to FIG. 13, which shows the eighth embodiment of the present invention. The front side of the socket panel 1 is pivotally connected to a charger 30. The rear end of the charger 30 is provided with terminals 301, and the front end of the charger 30 is provided with a connector (not shown). When the charger 30 is to be used, the charger 30 can be rotated with respect to the socket panel 1, so that the charger 30 can be selectively inserted into the insertion holes 61 of the socket unit 6 with the terminals 301 of the charger 30 being electrical connected with the terminals (not shown) in the insertion holes 61 of the socket unit 6. Thus, the electricity can be transmitted to the charger 30, so that the connector of the charger 30 can be used for charging an electronic product. In the present embodiment, the charger 30 has a panel connecting piece 302. The panel connecting piece 302 is a leaf spring that can be elastically extended or folded. One end of the panel connecting piece 302 is fixed to the charger 30, and the other end thereof is formed with a shaft 303. One side of the socket panel 1 is provided with a hole 18 in which the shaft 303 is pivotally connected to form a pivotal structure. With this arrangement, the charger 30 can be rotatably and pivotally connected to one side of the socket panel 1. However, the structure of the panel connecting piece 302 is not limited thereto as long as the panel connecting piece 302 can be used to connect the charger 30 and the socket panel 1.

Figure 14:
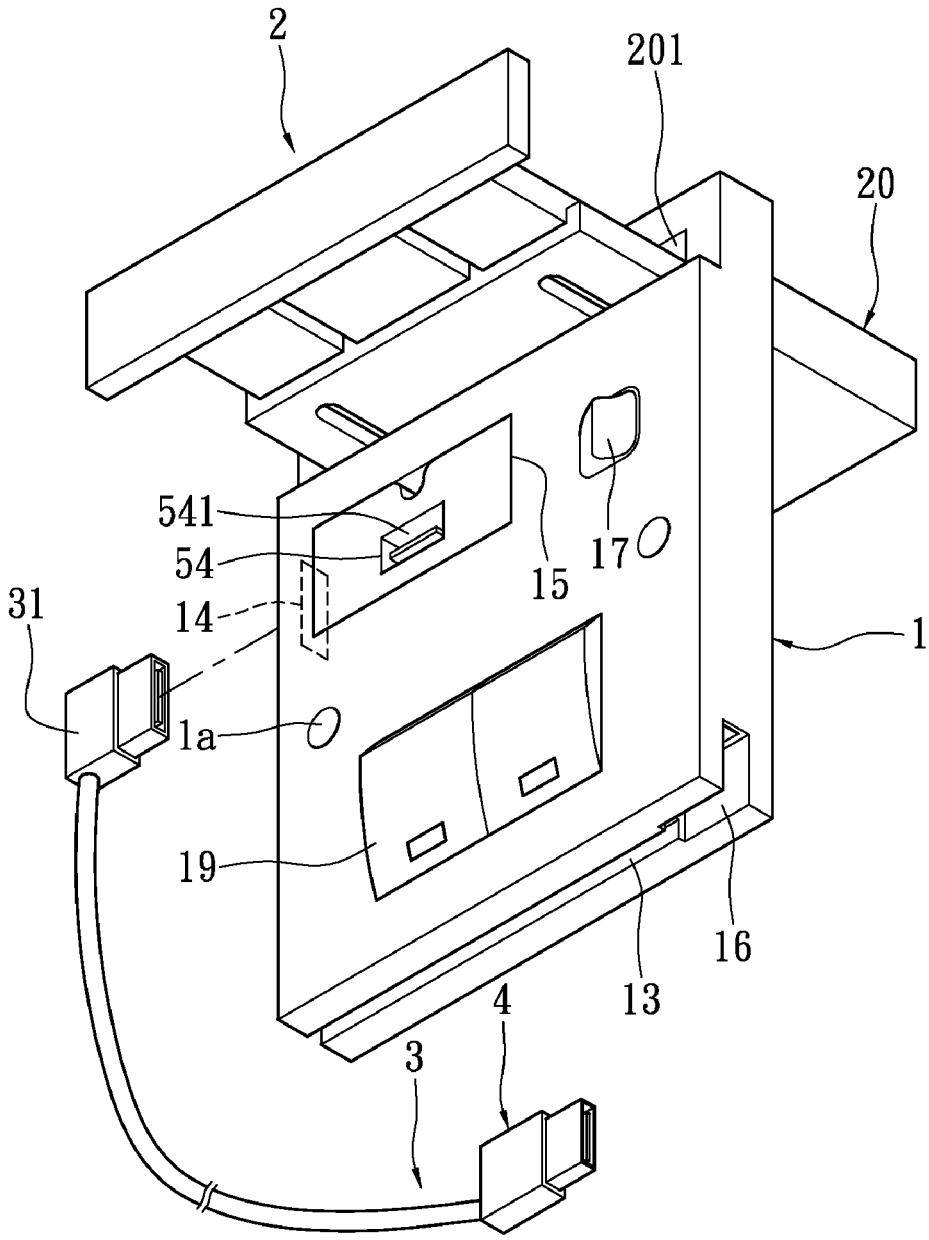
FIG. 14 is a perspective view showing the socket having a replaceable module according to a ninth embodiment of the present invention.

Please refer to FIG. 14, which shows the ninth embodiment of the present invention. The socket panel 1 has at least one switch 19. The switch 55 of the replaceable module 5 can be omitted. The socket panel 1 is provided with two perforations 1*a*. Screws can be inserted into the perforations 1*a* in order to fix the socket panel 1 to a wall or other places.

Figure 15:
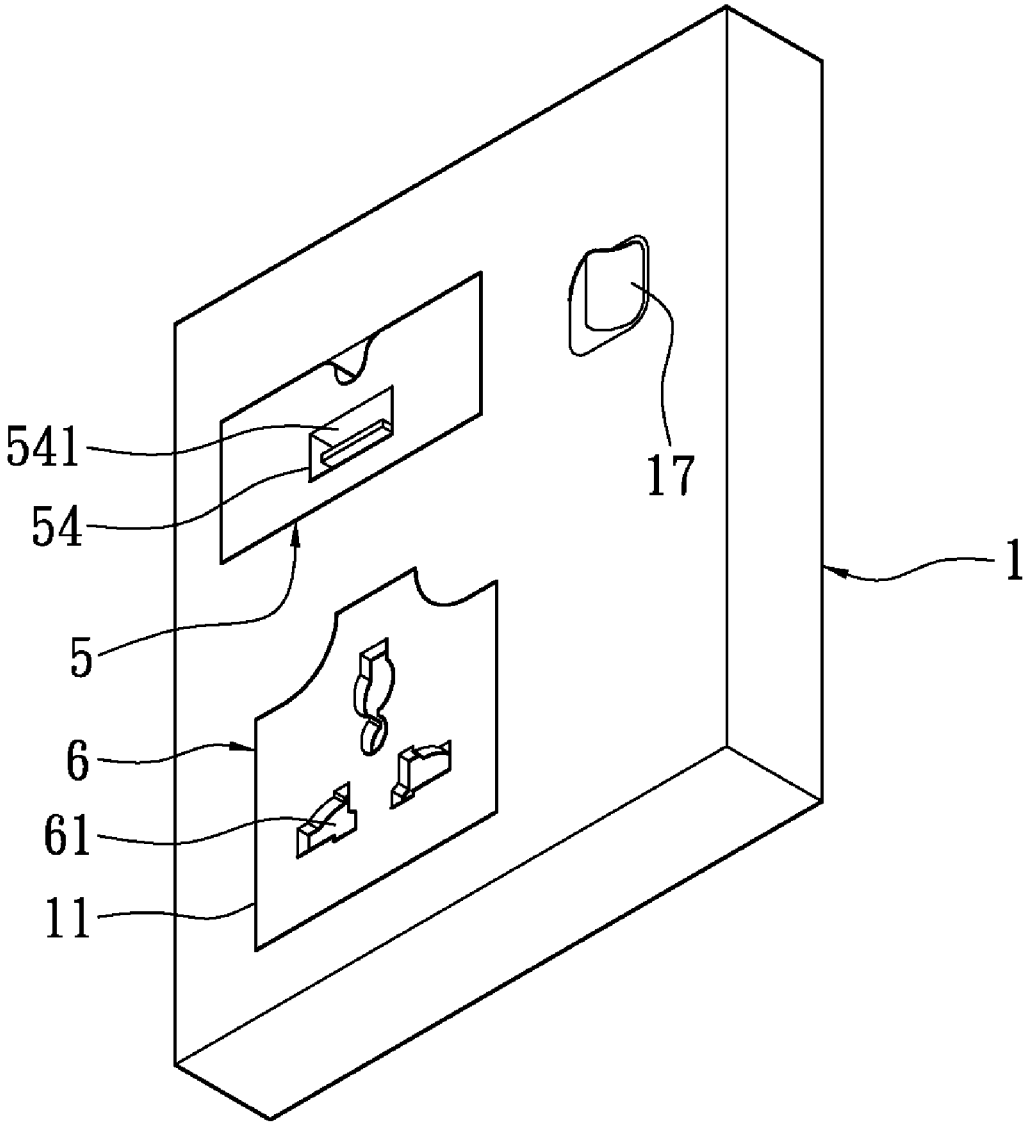
FIG. 15 is a perspective view showing the socket having a replaceable module according to a tenth embodiment of the present invention.

Please refer to FIG. 15, which shows the tenth embodiment of the present invention. The supporting plate 2, the connecting line 3 and the electrical connector 4 can be omitted.

Figure 16:
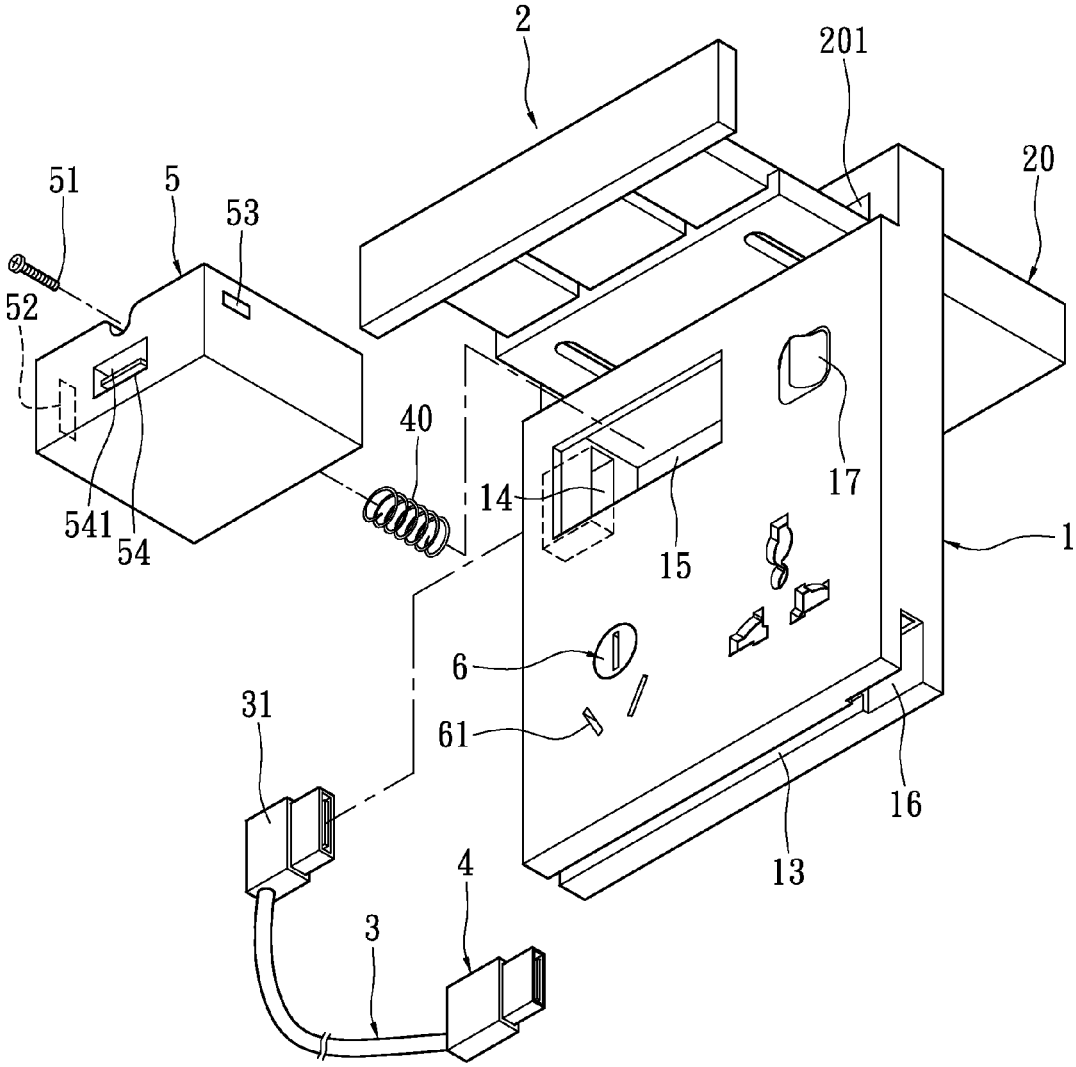
FIG. 16 is a perspective view showing the socket having a replaceable module according to an eleventh embodiment of the present invention.

Please refer to FIG. 16, which shows the eleventh embodiment of the present invention. At least one elastic element 40 can be provided between the socket panel 1 and the replaceable module 5. When the screw 51 is detached, the elastic element 40 forces the replaceable module 5 to move forwards, so that it is easy to detach the replaceable module 5 from the socket panel 1.

Figure 17:
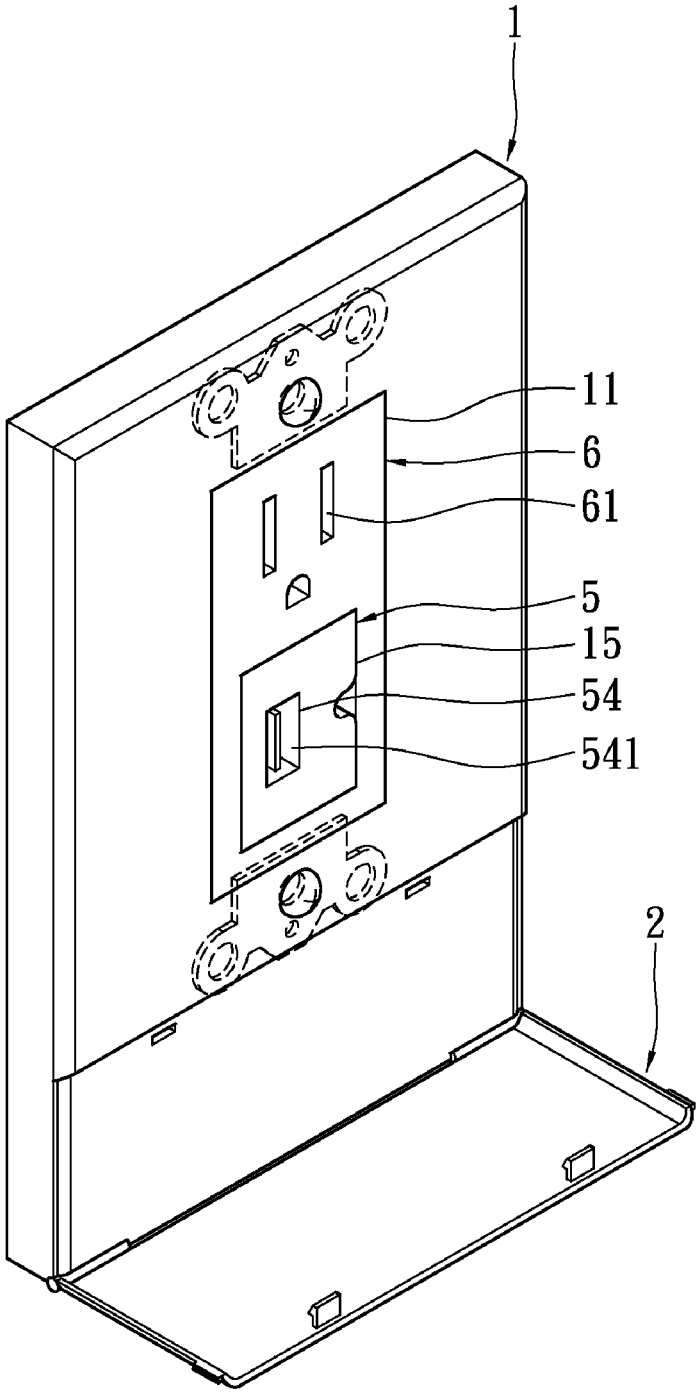
FIG. 17 is a perspective view showing the socket having a replaceable module according to a twelfth embodiment of the present invention.

Please refer to FIG. 17, which shows the twelfth embodiment of the present invention. The replaceable module 5 is provided upright on the socket panel 1.

Figure 18:
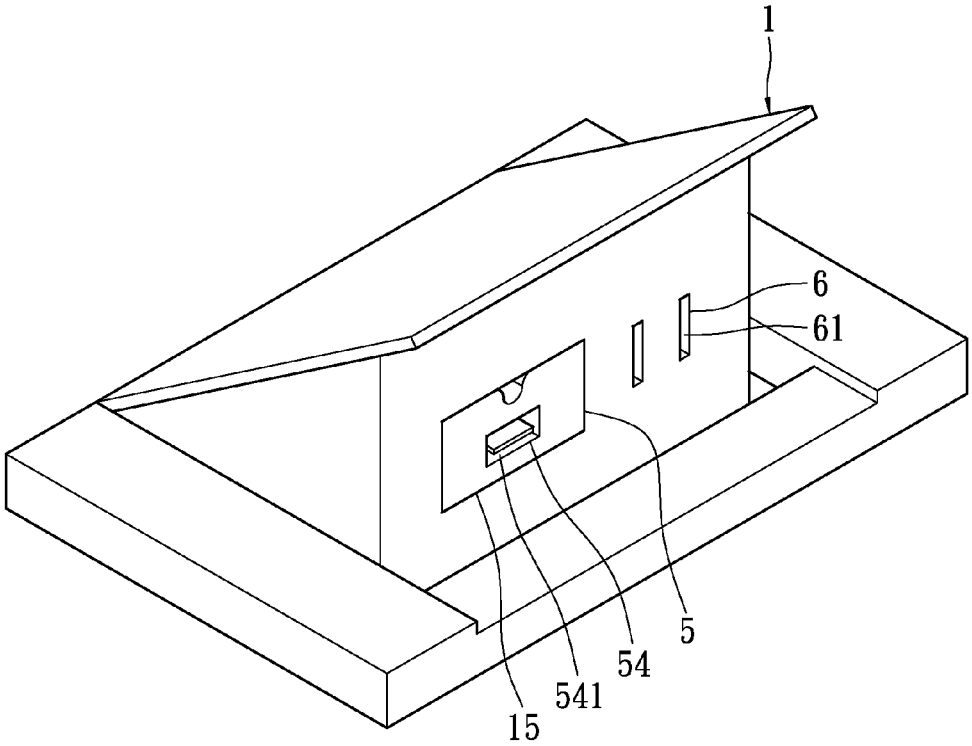
FIG. 18 is a perspective view showing the socket having a replaceable module according to a thirteenth embodiment of the present invention.

Please refer to FIG. 18, which shows the thirteenth embodiment of the present invention. The socket can be provided on a table or ground.

According to the present invention, the replaceable module 5 is detachably mounted on the socket panel 1, and the replaceable module 5 could provide different socket subunits 54 and switches 55. Therefore, the replaceable module 5 can be changed according to practical demands, which makes the replaceable module 5 more versatile. It is not necessary to manufacture various kinds of the socket panels 1. Thus, the manufacturing cost of the socket panel 1 can be reduced.

The replaceable module 5 can be used as a charger. When the replaceable module 5 suffers damage or the user intends to replace with other forms or dimensions of the replaceable modules 5, the replaceable module 5 can be detached easily from the socket panel 1. The replaceable module 5 can be adapted to cooperate with other products, such as various electrical outlets, wireless modules, timers or GFCI (Ground Fault Circuit Interrupter). GFCI is a residual current device, which is also known as a ground fault interrupter (GFI) or an appliance leakage current interrupter (ALCI). GFCI is an electrical wiring device that disconnects a circuit whenever it detects that the electric current is not balanced between the energized conductor and the return neutral conductor. The replaceable module 5 could be provided with GFCI therein, so that the socket of the present invention could provide a protective function if current leakage is happened.

Further, the edge of the replaceable module 5 is provided with a modular connector 52, whereby the connecting portion 31 can be inserted into the modular connector 52 when the connecting portion 31 is received in the receiving trough 14. The connecting portion 31 is inserted into the receiving trough 14 and the modular connector 52, thereby providing a better fixing effect. Thus, the connecting portion 31 can be firmly inserted into the socket panel 1 and the replaceable module 5 without falling off easily.

Since the replaceable module 5 is provided in the socket panel 1, the replaceable module 5 cannot be drawn out of the socket panel 1 easily even the screws 51 are detached. Thus, the replaceable module 5 can be protected from being touched by other people accidentally, thereby providing a better safety. The edge of the replaceable module 5 has a trough 56 hidden between the replaceable module 5 and the socket panel 1. The user has to insert a tool into the trough 56 so as to force the replaceable module 5 to move forwards. In this way, the replaceable module 5 can be repaired or replaced.

The above-mentioned descriptions represent merely the preferred embodiments of the present invention, without any intention to limit the scope of the present invention thereto. Various equivalent changes, alternations or modifications based on the claims of present invention are all consequently viewed as being embraced by the scope of the present invention.

What is claimed is:

1. A socket having a replaceable module, comprising:

a socket panel having a socket unit formed thereon;

a replaceable module detachably mounted on the socket panel, the replaceable module having a socket subunit disposed therein and a trough formed on an edge thereof, the trough being located between the replaceable module and the socket panel; and a connecting line having one end electrically connected to the replaceable module and another end connected to an electrical connector, the connecting line selectively surrounding the edge of the socket panel;

wherein the socket panel has an accommodating trough formed on an edge thereof, and the electrical connector is selectively received in the accommodating trough.

2. The socket having a replaceable module according to claim 1, wherein the socket panel has a receiving trough formed on an edge thereof, one end of the connecting line is connected to a connector portion, the replaceable module has a modular connector disposed on an edge thereof corresponding to the receiving trough, the connector portion is received in the receiving trough and is inserted into the modular connector.

3. The socket having a replaceable module according to claim 1, wherein the socket panel has a cable slot formed on an edge thereof, the connecting line selectively disposed in the cable slot at the edge of the socket panel.

4. The socket having a replaceable module according to claim 1, further comprising a supporting plate located on a front side of the socket panel, the supporting plate being turnably connected to the socket panel.

5. The socket having a replaceable module according to claim 1, wherein the socket panel has at least one switch.

6. The socket having a replaceable module according to claim 1, further comprising an accommodating box located on a rear side of the socket panel, wherein the accommodating box has an opening at a front side thereof, and a supporting plate disposed therein and being moveable forwards or rearwards along the opening.

7. The socket having a replaceable module according to claim 1, wherein the socket panel has at least one engaging portion, the socket unit is engaged with the engaging portion of the socket panel.

8. The socket having a replaceable module according to claim 1, wherein the socket panel has a receiving trough formed on the front side thereof, the replaceable module is received in the receiving trough.

9. The socket having a replaceable module according to claim 1, wherein the socket panel is pivotally connected to a charger, the charger has a connector and a plurality of terminals assembled in a rear end thereof, the terminals of the charger are selectively inserted into the socket unit.

10. The socket having a replaceable module according to claim 1, wherein the replaceable module has a plurality of locking holes, the trough is located in front of the locking holes, the locking holes are inserted with screws for fixing the replaceable module to the socket panel.

11. The socket having a replaceable module according to claim 1, wherein the trough is located in the middle of an upper edge of the replaceable module.

12. The socket having a replaceable module according to claim 1, wherein the replaceable module has a switch disposed thereon.

13. The socket having a replaceable module according to claim 1, wherein the replaceable module and the socket panel have a plurality of electrical contacts corresponding to each other, the electrical contacts of the replaceable module are electrically connected to the electrical contacts of the socket panel.

14. The socket having a replaceable module according to claim 1, wherein at least one elastic element is provided between the socket panel and the replaceable module.

* * * * *